US005271682A

United States Patent [19]

Realdon

[11] Patent Number: 5,271,682

[45] Date of Patent: Dec. 21, 1993

[54] WINDOW CLEANING DEVICE

[76] Inventor: Gianluigi Realdon, Via Ca' Megliadino, 39, 35044 Montagnana (PD), Italy

[21] Appl. No.: 809,163

[22] Filed: Dec. 18, 1991

[30] Foreign Application Priority Data

Feb. 19, 1991 [IT] Italy ..... PD91 A 000037

[51] Int. Cl.[5] ..... A46B 11/02; A47L 1/08

[52] U.S. Cl. ..... 401/37; 401/268; 401/285; 401/289; 401/146; 401/48; 401/185; 401/291

[58] Field of Search ..... 401/118, 38, 136, 48, 401/137, 146, 139, 37, 140, 191, 291, 290, 289, 287, 268, 286, 285, 283

[56] References Cited

U.S. PATENT DOCUMENTS

| | | | |
|---|---|---|---|
| 1,093,114 | 4/1914 | Corbett | 401/137 |
| 1,498,246 | 6/1924 | Spencer | 401/291 X |
| 1,894,420 | 1/1933 | Ranish | 401/283 X |
| 1,968,827 | 8/1934 | Grewe | 401/289 X |
| 2,722,701 | 11/1955 | Blum et al. | 401/139 |
| 2,731,656 | 1/1956 | Payne | 401/289 X |
| 2,815,522 | 12/1957 | Hexter | 401/139 X |
| 3,377,123 | 4/1968 | Leeson | 401/139 |
| 4,778,298 | 10/1988 | Shin et al. . | |
| 4,871,275 | 10/1989 | Aldous . | |

FOREIGN PATENT DOCUMENTS

| | | |
|---|---|---|
| 778785 | 7/1967 | Italy . |
| 956318 | 4/1964 | United Kingdom . |

OTHER PUBLICATIONS

"Vetrolamp" pamphlet, 1967, two pages.

*Primary Examiner*—Danton D. deMille

[57] ABSTRACT

A squeegee-type cleaning device for washing windows and other structures has a holder with a brush, a support for the holder, a wiper blade adjacent the brush and a fluid supply connected by a hose to the holder. Apertures provided along the length of the holder allow fluid to be pumped from the supply along the entire length of the brush. A manually operated pump is provided to pump this fluid. The brush is pivotable relative to the support and a telescopic pole can be provided on the support to aid in cleaning of the structure.

21 Claims, 4 Drawing Sheets

FIG. 9
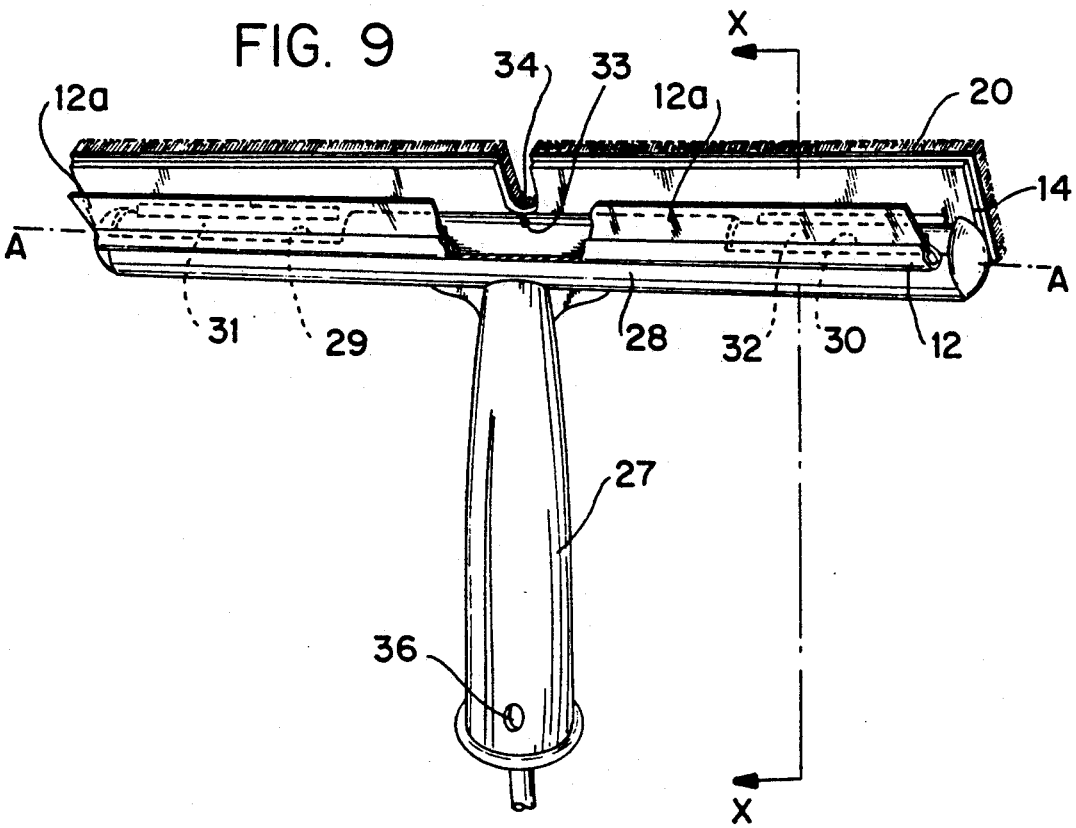
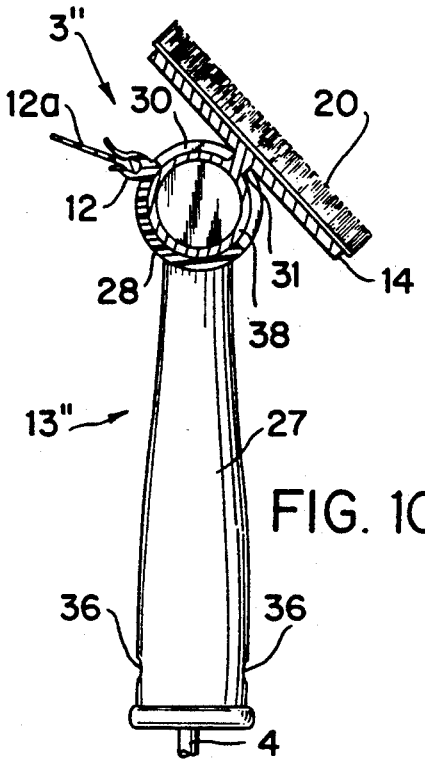
FIG. 10
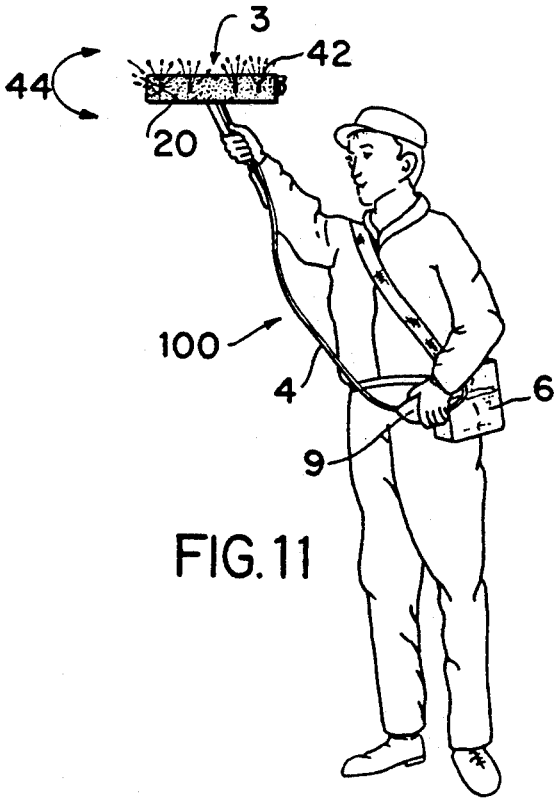
FIG. 11

WINDOW CLEANING DEVICE

BACKGROUND OF THE INVENTION

Field of the Invention

The present invention relates to a squeegee-type device for cleaning windows and other structures. This device has a pivotable holder with a brush, T-shaped support means, a blade, a fluid supply, a hose connecting the fluid supply to the support means and means for pumping the fluid.

Description of the Background Art

Various devices are known for cleaning windows and other planar surfaces. However, many of these devices are rather complicated to use and do not satisfactorily clean the structure. Because these devices are complicated, they are expensive to manufacture, more likely to malfunction and require extensive maintenance. Moreover, these cleaning devices are often unsatisfactory for cleaning different sized objects, especially large objects. It is often difficult to reach the areas of the object during cleaning with these prior art devices. Further, many of these prior art devices are heavy and therefore difficult to use over an extended period of time. Additionally, many prior art devices will not provide an even distribution of fluid. Therefore, if a brush is provided with these devices, it is impossible to evenly soak the brush with the fluid so that cleaning is difficult. Streaking of the window or other object when using such prior art cleaning devices is often a problem.

SUMMARY OF THE INVENTION

Accordingly, it is an object of the present invention to provide a cleaning device which will overcome the above-noted deficiencies.

In particular, it is an object of the present invention to provide a cleaning device which can easily be used to wash windows and other structures.

A further object of the present invention is to provide a cleaning device which is not complicated and therefore inexpensive to manufacture and requires little maintenance.

Yet a further object of the present invention is to provide a cleaning device which is light-weight and readily portable.

An additional object of the present invention is to provide a cleaning device which has great user flexibility such that different sized or positioned structures can easily be cleaned.

A further object of the present invention is to provide a cleaning device which will avoid streaking when cleaning windows and the like.

Yet another object of the present invention is to provide a cleaning device which will evenly distribute fluid along the length of a brush onto a surface to be cleaned such that when the brush contacts the surface, it will be thoroughly soaked and a thorough cleaning can be done.

These and other objects of the present invention are provided by a cleaning device having a holder with a brush mounted thereon. This holder has a plurality of apertures disposed along the length of the brush. A T-shaped support means is positionable beneath the holder for pivotably supporting the holder. This holder can be pivoted about an axis which is generally parallel to the longitudinal axis of the holder such that the brush can be moved relative to a vertical section of the support means. The brush on the holder is a fixed distance from the pivot axis even during pivoting of the holder. A blade is mounted adjacent the brush also at a fixed distance from the pivot axis. A supply of fluid is provided with a hose connecting this supply to either the support means or holder. Upon operation of a pumping means, the fluid will move from the supply, through the hose and out of apertures disposed along the length of the holder. Therefore, fluid will be supplied along the entire length of the brush.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIG. 9 is a front view of the support means and section holder of a third embodiment of the present invention;

FIG. 10 is a sectional side view of the third embodiment of the present invention taken along line X—X of FIG. 9; and FIG. 11 is a view showing an operator using the device of the present invention without a telescopic pole.

DETAILED DESCRIPTION OF THE PREFERRED EMBODIMENTS

Figure 1:
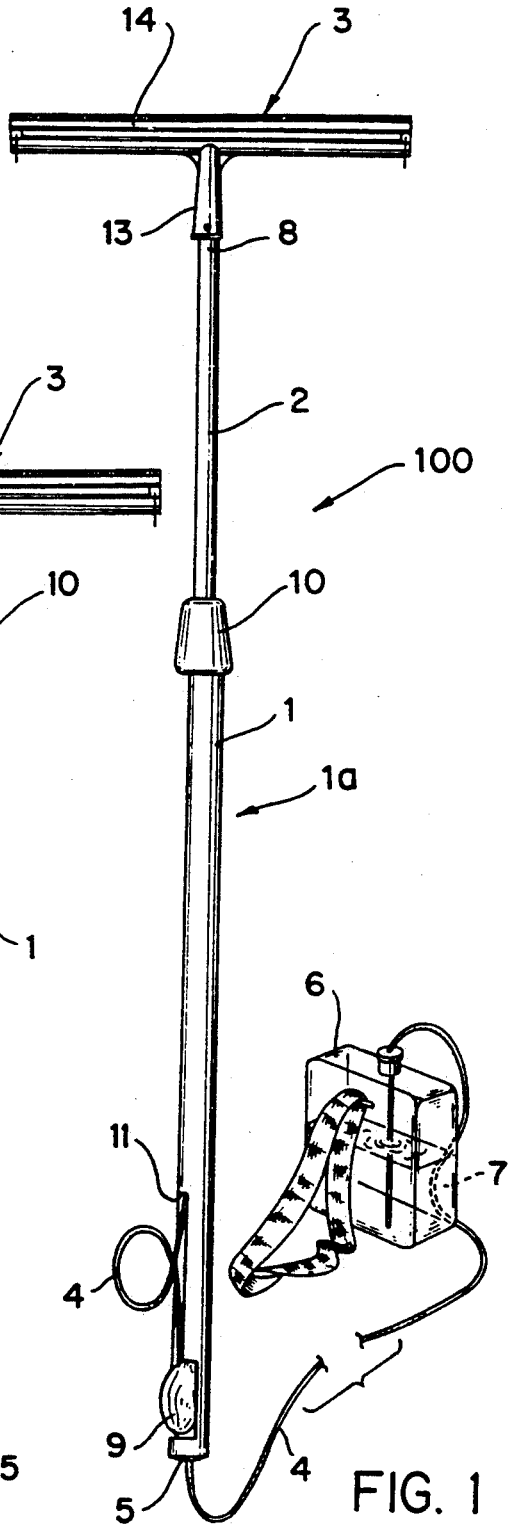
FIG. 1 is a front view of the cleaning device of the present invention with the telescopic pole in an extended position.

Referring now to the drawings and with particular reference to FIG. 1, a cleaning device 100 of the present invention is shown. This cleaning device 100 includes an optional telescopic pole 1*a*. The telescopic pole 1*a* is made up of the lower section 1 and an upper section 2 which can extend and retract relative to each other as shown between FIGS. 1 and 2. This pole 1*a* can be made from aluminum or any other suitable material.

At the upper end 8 of the upper section 2 of pole 1*a* is a T-shaped support means 13 with a holder 3. Various support means and holders can be attached to the telescopic pole 1*a* as will be discussed in more detail below. At the other end of Section 2 is lower section 1. Between these two sections 1 and 2, a locking collar 10 is provided. This locking collar 10 will hold the telescopic pole 1*a* in a selected position.

Figure 3:
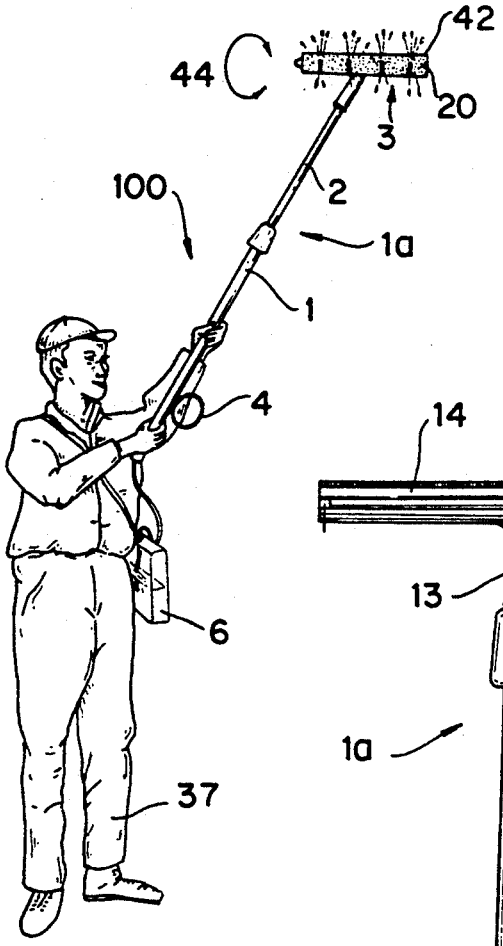
FIG. 3 is a view of the present invention showing an operator using the cleaning device.

On a side of the lower section 1, an opening 11 is provided. A hose 4 extends through this opening 11. This hose 4 is connected to a supply 6 of fluid 7. This supply 6 of fluid is a portable tank which can be carried on the shoulder of an operator 37 as shown in FIG. 3, for example. Within the supply 6 of fluid is a tube for connecting the fluid 7 to the hose 4. It should be understood that any suitable supply of fluid can be used in the instant invention. However, it is preferred that the supply of fluid be portable such that the instant cleaning device 100 can be easily moved.

As previously noted, the hose 4 extends through the opening 11 in the side of lower section 1. In this manner, extension and retraction of the sections 1 and 2 can be accommodated. The hose 4 will enter the end 5 of lower section 1 and extend to the end 8 of upper section 2. More hose 4 is needed inside the telescopic pole 1*a* when it is in the position shown in FIG. 1 because it is a further distance between the ends 5 and 8. Alternatively, when the telescopic pole 1*a* is in the retracted position of FIG. 2, the extra hose 4 can exit through opening 11. In this manner, extension and retraction of the telescopic pole 1*a* can be accommodated without the need for drawing hose 4 into and out of either end section 5 or 8.

Figure 2:
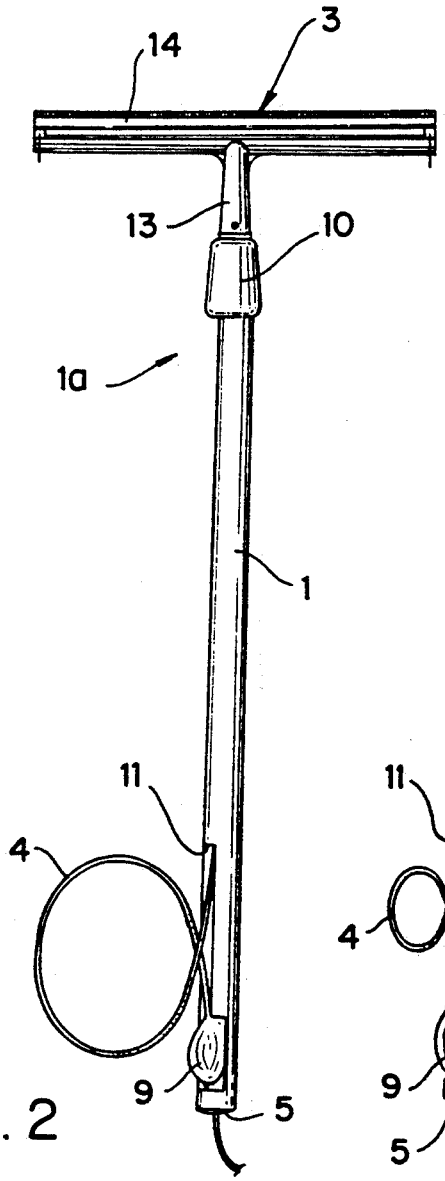
FIG. 2 is a front view of the present invention with the telescopic pole in a retracted position.

While FIG. 2 indicates the hose 4 extending from opening 11 as being spiraled, this hose can take any desired configuration. Moreover, an enclosure to receive this hose 4 can be provided at the side of the lower section 1 having the opening 11.

It should be understood that the hose 4 can actually comprise a plurality of sections which are fitted together by male-female removable sections. In this manner, the hose can be inserted into and removable from the telescopic pole 1*a*, for example.

As seen in FIGS. 1 and 2, a means 9 for pumping is provided in the opening 11. This means 9 can be a hand pump or other suitable device for withdrawing fluid from the supply 6. This means 9 is preferably hand operated such that the instant cleaning device 100 is relatively simple.

Because the means 9 is manually operated, a suitable amount of fluid can be applied to the surface to be cleaned. Therefore, if the operator 37 judges the window to be only slightly dirty, then only a minor amount of fluid can be used. However, if the window is very soiled, then a lot of cleaning can easily be dispensed from the instant cleaning device.

As seen in FIG. 3, the telescopic pole 1A of the instant invention can be extended such that large sized objects or awkwardly placed objects can easily be cleaned by the operator 37. The means 9 for pumping is under the hand of the operator in this FIG. 3.

Figure 4:
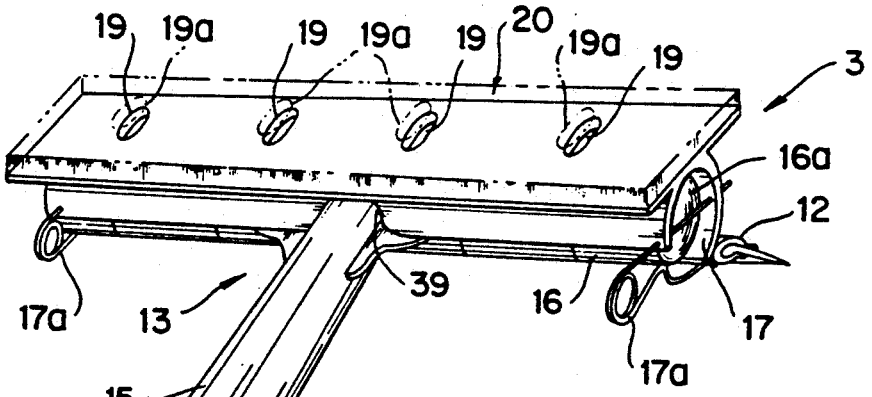
FIG. 4 is a sectional view of a first embodiment of the present invention showing the holder and support means.
Figure 5:
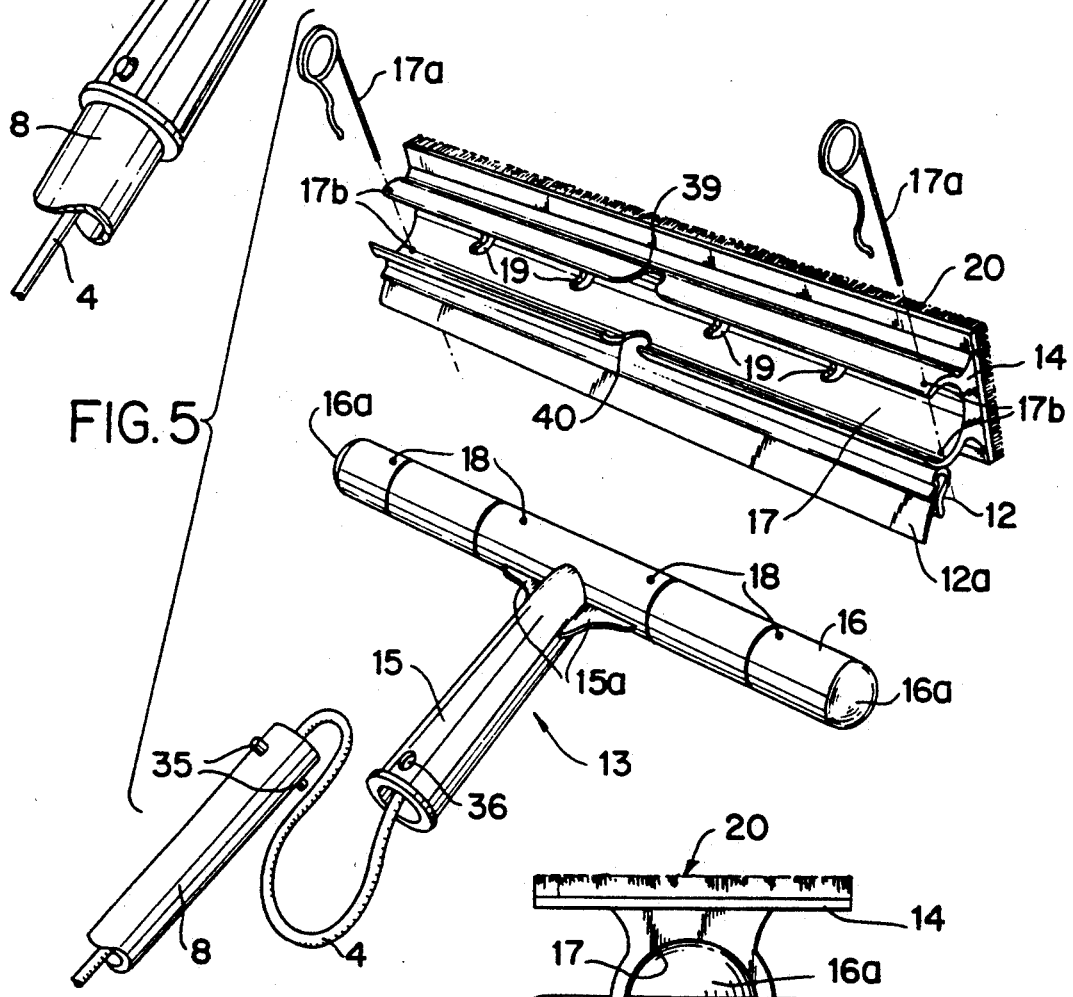
FIG. 5 is an exploded view of the first embodiment of the present invention shown in FIG. 4.
Figure 6:
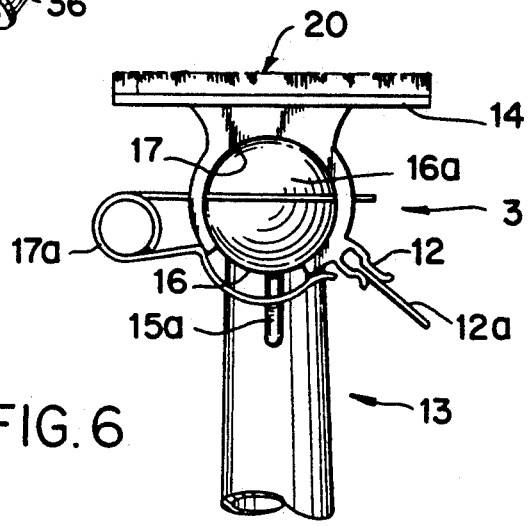
FIG. 6 is a side view of the first embodiment of the present invention shown in FIG. 4.

At the upper end of the telescopic pole 1*a* is the T-shaped support means 13 as noted above. This T-shaped support means has a holder 3 as seen in FIGS. 1 through 6. FIGS. 4–6 show a first embodiment of the instant cleaning device 100. In this embodiment, support means 13 and holder 3 are used but it should be recognized that the support means 13′ and holder 3′ of the second embodiment or support means 13″ and holder 3″ of the third embodiment or any combination of these holders and support means can be used with the instant cleaning device 100.

Turning now to FIG. 5, the T-shaped support means 13 is detached from the end 8 of the upper section 2. The hose 4 can be uncoupled such that the support means 13 can be totally separated from the pole 1*a*. Alternatively, male-female joints (not shown) can be included in hose 4 as previously discussed to complete the separation of the support means 13 and pole 1*a*.

Detents 35 on pole 1*a* are insertable into the holes 36 in T-shaped support means 13 in order to lock the support means onto the telescopic pole 1*a*. When it is desired to remove the support means, the detents 35 can be pressed inwardly and the telescopic pole 1*a* removed from the support means 13.

Springs (not shown) are used for forcing the detents 36 outwardly. In this manner, when an operator squeezes the detents 35 inwardly, the detents 35 will disengage from holes 36 such that the support means 13, 13′ or 13″ can easily be moved from the telescopic pole 1*a*. However, other suitable connection means can be used to affix the telescopic pole 1*a* to the support means. Accordingly, it should be recognized that the instant cleaning device 100 can be used with or without the telescopic pole 1*a*.

Returning now to FIGS. 4—6, more details of the first embodiment of the instant invention will now be described. As previously noted, this cleaning device has a T-shaped support means 13. This support means 13 has a vertical section 15 and a horizontal section 16. The sections 15 and 16 are generally perpendicular relative to one another. Through the center of the horizontal section 16 is a pivot axis A—A. As will be discussed in more detail below, the holder 3 is pivotable about this axis A—A. The holder 3 will therefore move toward and away from the vertical section 15 while being maintained at the same location relative to the horizontal section 16.

This holder 3 is readily mountable onto and detachable from the support means 13. As seen in FIG. 5, the holder 3 comprises a rigid plate 14 and a U-shaped section 17. These portions are integral with one another. On the upper side of plate 14, a short bristle brush 20 is provided. The U-shaped section 17 has an opening in the lower portion thereof. The size of this opening is less than the diameter of the horizontal section 16. In order to mount the holder 3 onto the support means 13, it is merely necessary to slide the holder 3 along the pivot axis A—A through the horizontal section 16. This horizontal section 16 has two ends 16*a*. As can be seen in FIG. 4, the horizontal section 16 is slightly shorter than the U-shaped section 17. Therefore, after the holder 3 is slipped along the horizontal section 16, clips 17*a* can be inserted through slots 17*b* on the holder 3. In this manner, the holder 3 will be affixed to the support means 13.

When mounted on the support means 13, the holder 3 can be pivoted about the pivot axis A—A. This holder 3 has a longitudinal axis extending along the length thereof. The longitudinal axis is generally parallel to the pivot axis A—A and the length of the holder 3. Extending along the length of this holder 3 are a plurality of apertures 19. When the holder 3 is mounted on the support means 13, these apertures 19 will be aligned with sprinklers 18 provided on the horizontal section 16. The sprinklers 18, apertures 19 and gaps 19*a* are all aligned to permit unobstructed ejection of fluid.

When the means 9 for pumping is actuated, the fluid from the supply 6 will flow through hose 4 and through the horizontal section 16. Apart from the opening for hose 4 and the sprinklers 18, this horizontal section 16 is sealed to prevent loss of the fluid. Therefore, when means 9 for pumping is activated, fluid will not leak from the ends of section 16.

The fluid in the instant device 100 will be ejected through sprinklers 18, through the various apertures 19 id and through gaps 19*a* in the brush 20. In this manner, the fluid can be ejected onto a surface, such as a window, to be cleaned. The fluid can be ejected from the cleaning device 100 at given distances depending upon the force applied by the means 9 for pumping.

Returning again to FIG. 5, a channel 12 is provided on the U-shaped section 17 of the holder 3. This channel 12 receives a blade 12*a*. Accordingly, the instant cleaning device 100 can act as a squeegee. The blade 12*a* is uninterrupted along its length and is pivotable with the brush 20 upon pivoting of the holder 3. The blade 12*a* can be slid into and removed from the channel 12. In this manner, the blade 12*a* can be replaced when it is worn.

Accordingly, it should be readily apparent that liquid can first be ejected from the cleaning device 100 upon operation of the means 9 for pumping. The brush 20 can then be used to scrub the surface. Finally, the blade 12*a* can be used to remove excess liquid and dirt from the cleaned surface. Haze or streaks can therefore be avoided when using the instant cleaning device. Windows, sliding glass doors, horizontal surfaces, boat hulls, and many other structures can be cleaned. Streaking of the structure is avoided with the instant invention.

Provided in the U-shaped section 17 are a first recess 39 and second recess 40. These recesses increase the angle through which the holder 3 can pivot. In this embodiment, the brush 20 and plate 14 can be pivoted in an arc of 80°–90°. As seen in FIG. 4, the vertical section 15 can be engaged within the recess 39 when the holder 3 is at one maximum pivot position. As should readily be apparent, the holder 3 can be pivoted to an opposite position in which the vertical section 15 will engage the second recess 40. Therefore, the extremes of the arc through which the holder 3 pivots is determined by the vertical section 15 sitting into one of the recesses 39, 40. When the vertical section 15 is sitting in recesses 39, the operator can rotate the device 100 by 180° in order to use blade 12*a*.

This vertical section 15 has a flange 15*a* provided for additional support. At the lower end of the vertical section 15 is the hole 36 for detent 35 which has previously been discussed.

A second embodiment of the instant cleaning device will now be discussed with reference to FIGS. 7 and 8. In this embodiment the hose 4 is exposed at 26 at the upper end 21*a* of vertical section 21 of the support means 13'. Further, a different holder 3' is used in this embodiment. However, it should be remembered that any combination of support means and holders can be used in the instant cleaning device as previously noted.

This holder 3' has a generally circular section 23 mounted to the underside of plate 14. On the top surface of this plate 14 is the brush 20. This circular section 23 will be received in the C-shaped section 22 of the T-shaped support means 13'. This C-shaped section 22 is the horizontal section of the support means 13'. Thus, this support means 13' is also composed of a horizontal C-shaped section 22 and a generally perpendicular vertical section 21. This vertical section 21 has a flange portion 24. This flange portion 24 is rigidly mounted to the C-shaped section 22. Therefore, the support means 13' is rigid. However, the holder 3' is pivotable relative to the support means 13'. In particular, the circular section 23 can pivot about axis A-A within the C-shaped section 22 in order to pivot the brush 20 relative to the vertical section 21.

Figure 7:
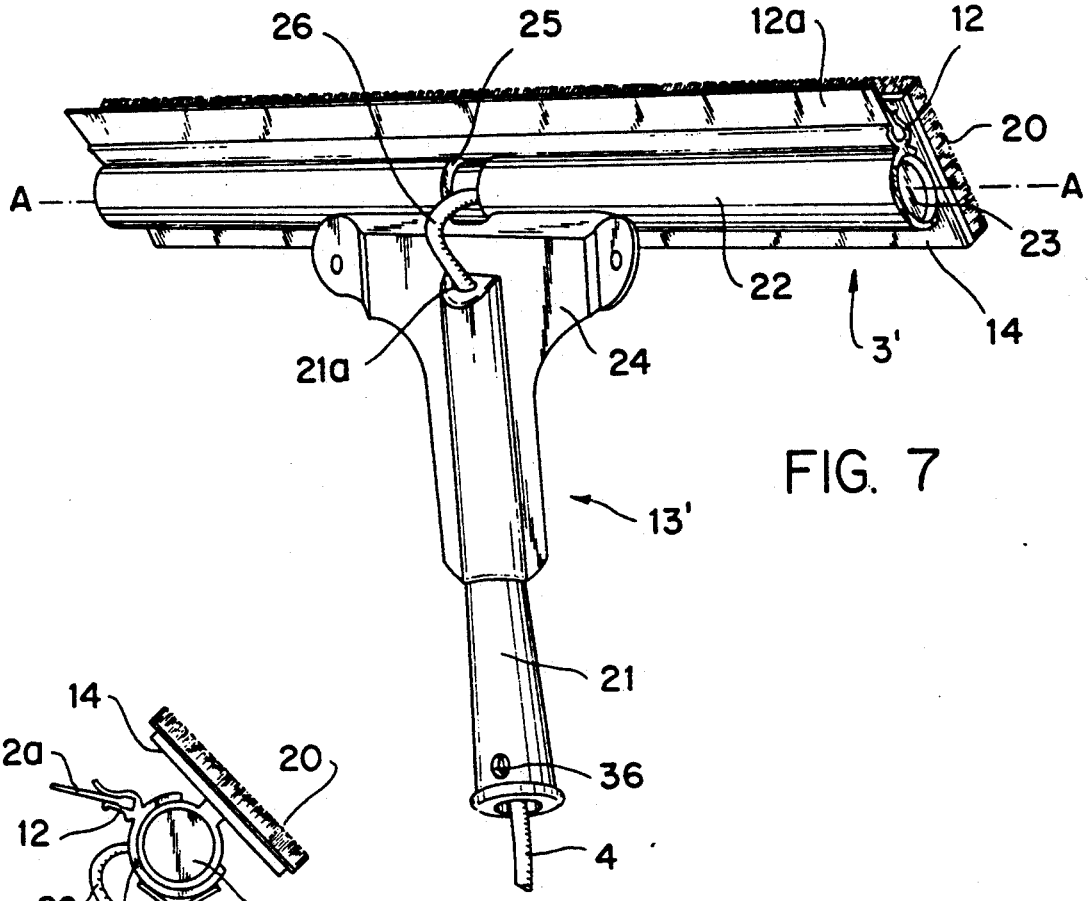
FIG. 7 is a front view of the holder and support means of the second embodiment of the present invention.
Figure 8:
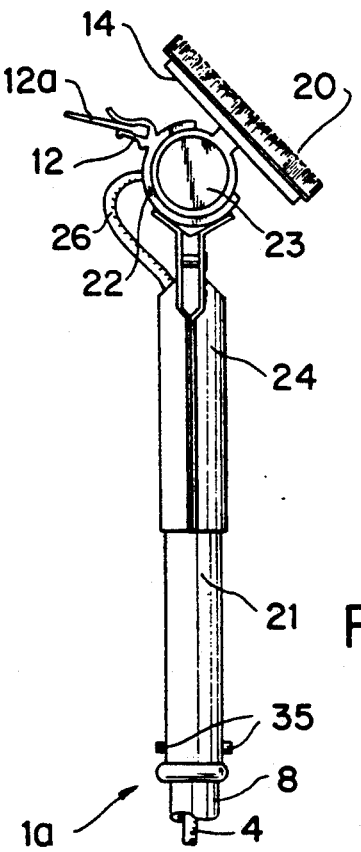
FIG. 8 is a side view of the second embodiment of the present invention shown in FIG. 7.

In the arrangement shown in FIGS. 7 and 8, the plate 14 can be pivoted through an arc of 70°–80°. The edges of the C-shaped section 22 will limit pivoting of this holder 3'. Due to the elasty and curve of the exposed portion 26, the hose 4 can readily accommodate pivoting of the holder 3'. While the sprinklers are not shown in this embodiment, it should readily be understood how fluid is ejected from the interior of the circular section 23 through sprinklers connecting this section with the plate 14 and past the brush 20. Similarly to horizontal section 16 of the first embodiment, the circular section 23 is sealed to prevent leaking of fluid.

As seen in FIGS. 7 and 8, the channel 12 is mounted on the C-shaped section 22. This channel 12 is located such that blade 12A will not interfere with pivoting of the plate 14. It should be apparent that the plate 14 is pivotable while the blade 12A is fixed in this second embodiment.

A slot 25 is provided in the mid-section of the C-shaped section 22. This slot 25 enables the exposed portion 26 of hose 4 to extend from the upper end 21A of the vertical section 21 into the circular section 23. Means are provided between the circular section 23 such that fluid traveling through the hose 4 and exposed section 26 into the circular section 23 can be ejected through plate 14. As previously noted, the brush 20 has gaps to mate with the areas of the C-shaped section 22 which eject fluid. In this arrangement, fluid is dispensed along the length of the circular section 23 such that the entire length of the brush 20 can quickly be soaked when the brush comes into contact with the surface having the fluid squirted thereon.

At the lower end of the vertical section 21, holes 36 are provided. These holes 36 can receive the detents 35 at the end 8 of the telescopic pole 1*a*. However, it should be understood that the first, second or third embodiments can be used without the telescopic pole 1*a* as shown, for example, in FIG. 11.

Turning now to the arrangement shown in FIG. 9–11, a third embodiment of the instant cleaning device is shown. In this embodiment, a holder 3" and a T-shaped support means 13" are used. The holder 3" comprises a circular section 38 mounted to the plate 14 by first and second connections 31 and 32. The connections 31 and 32 are provided on the lower side of the plate 14 while the brush 20 is provided on an upper side thereof. A recess 34 in plate 14 is indicated in FIG. 9. The recess 34 provides a gap in the plate 14 and brush 20 for a sprinkler 33 on tube 28. This tube 28 will be discussed in more detail below. While only one recess 34 is used in FIG. 9 with one sprinkler 33, it should be understood that plural recesses and sprinklers can also be used in this embodiment along the length of tube 28.

The T-shaped support means 13' comprises the tube 28 connected with hose 4 through vertical section 27. This tube 28 is a horizontal section of the T-shaped support means 13". The vertical section 27 is generally perpendicular to the tube 28. The holder 3" is pivotable about axis A—A relative to the vertical section 27.

Stoppers are provided in tube 28 just before each of the C-shaped openings 29,30. These stoppers form a seal with tube 28 to prevent outward flow of fluid. The fluid will be contained in tube 28 between first and second connections 31,32. These connections 31 and 32 are mounted on plate 14 and extend through the C-shaped openings 29 and 30 whereby plate 14 can be pivoted until the connections 31 and 32 contact the edges of the openings 29,30. The C-shaped openings 29 and 30 are extensions of the tube 28 through which the first and second connections 31 and 32 pass. Fluid will only be positioned in tube 28 between the stoppers just before these connections 31 and 32. Due to these connections, the holder 3'' is affixed to the support means 13''.

At the lower end of the vertical section 27 are holes 36 for receiving the detents 35. In this manner, the third embodiment of the present invention can be used with or without a telescopic pole 1*a* as previously noted.

While the arrangement shown in FIG. 11 shows the brush 20 as having fluid 42 ejected therefrom with some force, it should be understood that the means 9 for pumping can be gently operated. Fluid is simply sprayed from the device 100 in the amount required.

In the arrangement of FIGS. 10 and 11, operation of the means 9 for pumping will cause fluid to move through hose 4 and into the circular section 38. This fluid will then be ejected through sprinkler 33. In this manner, the entire brush can be thoroughly soaked similarly to the first and second embodiments.

The plate 14 of the holder 3 is pivotable about axis A—A. The limits of pivoting are defined by the ends of the openings 29 and 30 contacting the connections 31 and 32, respectively. The channel 12 is located in a non-interfering position for pivoting of the plate 14. This channel 12 is mounted on the tube 28 and C-shaped extensions 29,30. Therefore, the plate 14 can be pivoted relative to the blade 12*a*. In other words, the blade 12*a* will be stationary while the brush 20 and plate 14 are pivoted.

Accordingly, a cleaning device 100 has now been described which can supply fluid along the length of a brush onto a surface to be cleaned. In this manner, a wide area of a surface, such as a window can be quickly cleaned. An operator 37 will merely actuate pump means 9. In other words, the hand pump 9 will be squeezed by an operator to withdraw fluid 7 from supply 6. This fluid will travel through hose 4 and through the telescopic pole 1*a* (if this pole is used). The fluid can then travel through either the T-shaped support 13 of the first embodiment or the horizontal section of the support means 13' or 13'' of the second and third embodiments before being ejected onto the surface. In each embodiment, the holders 3, 3' or 3'' are pivotable about axis A–A relative to the support means 13, 13' or 13'', respectively, as indicated in FIGS. 3 and 11 by arrow 44. In this manner, different positioned surfaces can easily be cleaned.

The instant cleaning device is relatively simple. Therefore, it is easy to use and inexpensive to manufacture. Extensive maintenance of the cleaning device is avoided. Depending upon how the operator uses the means 9 for pumping, fluid can be ejected therethrough in different amounts. This fluid can be used to clean the surface, such as a window. After the brush 20 scrubs this surface, the cleaning device 100 can be flipped over. Then, the blade 12*a* can be used to remove any remaining fluid. This fluid 7 can be water and soap or any other suitable combination.

Due to pivoting of the plate 14, the brush 20 in the instant invention can be constantly kept flat on the surface to be cleaned. Therefore, it is not necessary for the operator to twist the handle of the cleaning device in use. Accordingly, high windows can easily be cleaned with the instant cleaning device 100.

Also, upon operation of the means 9 for pumping, the fluid is instantaneously delivered to the area of the brush once the hose 4 and horizontal section 16 or circular section 23 or circular section 38 are filled with fluid. Therefore, the instant invention will not waste the fluid and will be quick to use.

Due to the small size of the hose 4 of the instant invention, the fluid therein is limited such that the weight of the instant invention is limited. The instant cleaning device 100 is only a few ounces and therefore can easily be used by many different people.

The instant cleaning device is very flexible and lightweight as noted above. It is easy to use and will satisfactorily clean surfaces, such as windows. While it has been described that the instant cleaning device can be used for cleaning windows, it should be understood that many different structures can be cleaned with the instant cleaning device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cleaning device comprising:

a holder having a longitudinal axis and at least one aperture defined therein, said at least one aperture being disposed along the longitudinal axis;

a brush provided on a top surface of the holder;

t-shaped support means positionable beneath the holder for pivotally supporting the holder, the holder being pivotable about a pivot axis which is generally parallel to the longitudinal axis, said support means having a vertical section and a horizontal section arranged perpendicularly to one another, the horizontal section being generally parallel to the longitudinal axis when the support means is supporting the holder, the holder being pivotable about the pivot axis to move the brush relative to the vertical section of the support means, the brush on the holder remaining a fixed distance from the pivot axis when the support means is supporting the holder;

a readily detachable blade mounted adjacent the brush, the blade being a fixed distance from the pivot axis and being generally parallel to the longitudinal axis;

a supply of fluid;

a hose connecting the supply of fluid to one of the support means and holder;

means for pumping the fluid from the supply, through the hose, out of the at least one aperture on the holder and past in the brush, the fluid being supplied along a length of the brush generally parallel to the longitudinal axis, the liquid being sealed in the cleaning device such that the liquid is only released through the at least one aperture; and a telescopic pole having a first and second end, the support means being detachably mounted to the second end of the telescopic pole and the hose extending through the first and second ends of the pole and along an inside of the pole, the pole having an opening defined in a side thereof, the hose extending through said opening, the opening enabling the hose to slide into and out of the pole during telescopic movement of the pole while the hose continues to extend through both the first and second ends of the poles without moving relative to these ends.

2. The cleaning device as recited in claim 1, wherein the brush is a short bristle brush, the fluid being ejected through gaps in the brush along the length thereof upon operation of the means for pumping.

3. The cleaning device as recited in claim 1, wherein the pole comprises an upper section and a lower section with a locking collar therebetween, the upper and lower sections being extendable and retractable for telescopic movement of the pole and the locking collar being operable to lock the sections in position, the opening being provided in a side of the lower section.

4. The cleaning device as recited in claim 1, wherein the means for pumping is accommodated in the opening in the side of the pole, said means for pumping comprising a manually operated hand pump for withdrawing the fluid from the supply, forcing the fluid through the hose and ejecting the fluid along the length of the brush.

5. The cleaning device as recited in claim 1, wherein the means for pumping comprises a manually operated hand pump for withdrawing the fluid from the supply, forcing the fluid through the hose and ejecting the fluid along the length of the brush, the supply of fluid being a portable tank.

6. The cleaning device as recited in claim 1, wherein the hose is connected to the support means, the support means having a plurality of sprinklers provided along a length of the horizontal section, the sprinklers being aligned with the at least one aperture in the holder whereby the means for pumping supplies fluid through the hose, along an interior of the horizontal section of the support means, through the sprinklers and out of the at least one aperture of the holder.

7. The cleaning device as recited in claim 6, wherein the holder comprises a plate and a U-shaped section, the brush being mounted to a top surface of the plate and the U-shaped section being mounted to a bottom surface of the plate, the U-shaped section being in mating engagement with the horizontal section of the support means when the support means is supporting the holder, the at least one aperture in the holder extending through the plate and U-shaped section.

8. The cleaning device as recited in claim 6, wherein the holder is detachably mounted on the support means, the U-shaped section having a greater length then the horizontal section and having slots defined at the ends thereof, said cleaning device further comprising clips which are insertable through the slots to detachably mount the holder to the support means, the U-shaped section being sized such that the holder can be slid over an end of the support means in a direction generally parallel to the pivot axis in order to mount the holder on the support means and the clips thereafter being inserted into the slots to hold the holder on the support means.

9. The cleaning device as recited in claim 6, wherein the blade is rigidly mounted on the holder and pivotable therewith.

10. The cleaning device as recited in claim 1, wherein the blade is rigidly mounted on the holder and pivotable therewith.

11. The cleaning device as recited in claim 1, wherein the holder comprises a plate and a generally circular section and the horizontal section of the support means comprises a C-shaped section, the brush being mounted to a top surface of the plate and the circular section being mounted to a bottom surface of the plate, the circular section being slidably received within the C-shaped section of the support means to permit pivoting of said holder.

12. The cleaning device as recited in claim 11, wherein the C-shaped section has a slot defined therein and wherein the hose extends from an upper end of the vertical section of the support means, through the slot in the C-shaped section and to the circular section of the holder, the hose having a predetermined length exposed between the upper end of the vertical section and the circular section to permit pivoting of the holder.

13. The cleaning device as recited in claim 11, wherein the blade is rigidly mounted on the C-shaped section of the support means, the blade extends uninterrupted along a length of the C-shaped support means.

14. The cleaning device as recited in claim 1, wherein the blade is rigidly mounted on the support means in a position avoiding interference with pivoting of the holder, the blade being fixed in position while the holder is pivotable.

15. The cleaning device as recited in claim 1, wherein the holder has a recess defined therein for receiving the vertical section of the support means when the holder reaches a maximum angle for pivoting in at least one direction.

16. The cleaning device as recited in claim 1, further comprising sprinklers defined along the length of the horizontal asection of the T-shaped support means, the brush being a short bristle brush with gaps provided therein, the gaps being registered with the at least one aperture in the holder and with the sprinklers to permit ejection of the fluid along the length of the brush.

17. A cleaning device comprising:

a holder having a longitudinal axis and at least one aperture defined therein, said at least one aperture being disposed along the longitudinal axis, the holder comprises a plate and a generally circular section;

a brush provided on a top surface of the holder;

t-shaped support means positionable beneath the holder for pivotally supporting the holder, the holder being pivotable about a pivot axis which is generally parallel to the longitudinal axis, said support means having a vertical section and a horizontal section arranged perpendicularly to one another, the horizontal section being generally parallel to the longitudinal axis when the support means is supporting the holder, the holder being pivotable about the pivot axis to move the brush relative to the vertical section of the support means, the brush on the holder remaining a fixed distance from the pivot axis when the support means is supporting the holder, the horizontal section of the support means comprises a tube enclosing the circular section of the holder, the circular section being mounted to a bottom surface of the plate through mounting openings defined in the tube and the brush being mounted on a top surface of the plate, the mounting openings being sized to permit pivoting of the holder about the pivot axis;

a readily detachable blade mounted adjacent the brush, the blade being a fixed distance from the pivot axis and being generally parallel to the longitudinal axis;

a supply of fluid;

a hose connecting the supply of fluid to one of the support means and holder; and means for pumping the fluid from the supply, through the hose, out of the at least one aperture on the holder and past the brush, the fluid being supplied along a length of the brush generally parallel to the longitudinal axis, the liquid being sealed in the cleaning device such that the liquid is only released through the at least one aperture.

18. The cleaning device as recited in claim 17, further comprising sprinklers defined along the length of the horizontal section of the T-shaped support means, the hose extends through the vertical section of the support means to the circular section of the holder, the circular section of the holder extends along the longitudinal axis and provides for communication to the sprinklers on the holder such that the means for pumping can supply fluid through the hose and out of the sprinklers along the length of the brush.

19. The cleaning device as recited in claim 17, wherein the blade is rigidly mounted on the tube avoiding obstruction of the mounting openings, the blade extends uninterrupted along most of a length of the tube.

20. A cleaning device comprising:

a holder having a longitudinal axis and at least one aperture defined therein, said at least one aperture being disposed along the longitudinal axis;

a brush provided on a top surface of the holder;

t-shaped support means positionable beneath the holder for pivotally supporting the holder, the holder being pivotable about a pivot axis which is generally parallel to the longitudinal axis, said support means having a vertical section and a horizontal section arranged perpendicularly to one another, the horizontal section being generally parallel to the longitudinal axis when the support means is supporting the holder, the holder being pivotable about the pivot axis to move the brush relative to the vertical section of the support means, the brush on the holder remaining a fixed distance from the pivot axis when the support means is supporting the holder;

a readily detachable blade mounted adjacent the brush, the blade being a fixed distance from the pivot axis and being generally parallel to the longitudinal axis;

a supply of fluid;

a hose connecting the supply of fluid to the support means;

means for pumping the fluid from the supply, through the hose, out of the at least one aperture on the holder and past the brush, the fluid being supplied along a length of the brush generally parallel to the longitudinal axis, the liquid being sealed in the cleaning device such that the liquid is only released through the at least one aperture;

the support means having a plurality of sprinklers provided along a length of the horizontal section, the sprinklers being aligned with the at least one aperture in the holder whereby the means for pumping supplies fluid through the hose, along an interior of the horizontal section of the support means, through the sprinklers and out of the at least one aperture of the holder;

the holder being detachably mounted on the support means, the U-shaped section having a greater length than the horizontal section and having slots defined at the ends thereof; and clips insertable through the slots to detachably mount the holder to the support means, the U-shaped section being sized such that the holder can slide over an end of the support means in a direction generally parallel to the pivot axis in order to mount the holder on the support means and the clips thereafter being inserted into the slots to hold the holder on the support means.

21. A cleaning device comprising:

a holder having a longitudinal axis and at least one aperture defined therein, said at least one aperture being disposed along the longitudinal axis, the holder comprises a plate and a generally circular section;

a brush provided on a top surface of the holder;

t-shaped support means positionable beneath the holder for pivotally supporting the holder, the holder being pivotable about a pivot axis which is generally parallel to the longitudinal axis, said support means having a vertical section and a horizontal section arranged perpendicularly to one another, the horizontal section being generally parallel to the longitudinal axis when the support means is supporting the holder, the holder being pivotable about the pivot axis to move the brush relative to the vertical section of the support means, the brush on the holder remaining a fixed distance from the pivot axis when the support means is supporting the holder, the horizontal section of the support means comprises a C-shaped section, the brush being mounted to a top surface of the plate of the holder and the circular section of the holder being mounted to a bottom surface of the plate, the circular section being slidably received within the C-shaped section of the support means to permit pivoting of said holder;

a readily detachable blade mounted adjacent the brush, the blade being a fixed distance from the pivot axis and being generally parallel to the longitudinal axis;

a supply of fluid;

a hose connecting the supply of fluid to one of the support means and holder; and means for pumping the fluid from the supply, through the hose, out of the at least one aperture on the holder and past the brush, the fluid being supplied along a length of the brush generally parallel to the longitudinal axis, the liquid being sealed in the cleaning device such that the liquid is only released through the at least one aperture;

the C-shaped section having a slot defined therein and wherein the hose extends from an upper end of the vertical section of the support means, through the slot in the C-shaped section and to the circular section of the holder, the hose having a predetermined length exposed between the upper end of the vertical section and the circular section to permit pivoting of the holder.

* * * * *